US006036580A

United States Patent [19]

Igelshteyn et al.

[11] Patent Number: 6,036,580

[45] Date of Patent: Mar. 14, 2000

[54] METHOD AND DEVICE FOR MAGNETIC-ABRASIVE MACHINING OF PARTS

[75] Inventors: Leonid Igelshteyn, Manalapan; Savva Feygin, Manalpan, both of N.J.; Gennady Kremen, Brooklyn, N.Y.

[73] Assignee: Scientific Manufacturing Technologies, Inc., Brooklyn, N.Y.

[21] Appl. No.: 09/262,637

[22] Filed: Mar. 4, 1999

Related U.S. Application Data

[63] Continuation-in-part of application No. 08/922,829, Sep. 3, 1997, abandoned.

[51] Int. Cl.[7] ..... B24B 1/00

[52] U.S. Cl. ..... 451/36; 451/103; 451/104; 451/113

[58] Field of Search ..... 451/36, 37, 103, 451/104, 113

[56] References Cited

U.S. PATENT DOCUMENTS

| | | | |
|---|---|---|---|
| 4,169,713 | 10/1979 | Chachin et al. | 451/113 |
| 4,186,528 | 2/1980 | Yascheritsyn et al. | 451/113 |
| 4,211,041 | 7/1980 | Sakulevich et al. | 451/113 |
| 4,306,386 | 12/1981 | Sakulevich et al. | 451/113 |
| 4,601,431 | 7/1986 | Watanabe et al. | 451/113 |
| 4,821,466 | 4/1989 | Kato et al. | 451/113 |
| 5,401,206 | 3/1995 | Majors | 451/113 |
| 5,419,735 | 5/1995 | Imahashi et al. | 451/113 |
| 5,616,066 | 4/1997 | Jacobs et al. | 451/113 |

FOREIGN PATENT DOCUMENTS

| | | | |
|---|---|---|---|
| 62-39172 | 2/1987 | Japan | 451/113 |

*Primary Examiner*—Eileen P. Morgan
*Attorney, Agent, or Firm*—I. Zborovsky

[57] ABSTRACT

Magnetic-abrasive machining of a parts is performed by generating a magnetic field by two different poles located near one another so as to form a magnetic gradient region with magnetic flux lines which extend from one pole in one direction and then in an opposite direction to another pole and therefore are round in a predetermined plane, placing a part to be machined exclusively at one side of the two poles, introducing a magnetic-abrasive powder between the poles and the part to be machined so that a portion of the part to be machined is located in the magnetic gradient region with the round magnetic flux lines, and moving the part to be machined relative to the poles in the same plane transversely to the round magnetic flux lines of the magnetic gradient region so that portions of the part to be machined successively pass the magnetic gradient region with the round magnetic flux lines and are machined by the magnetic-abrasive powder retained in the magnetic gradient region with the round magnetic flux lines.

6 Claims, 3 Drawing Sheets

METHOD AND DEVICE FOR MAGNETIC-ABRASIVE MACHINING OF PARTS

CROSS REFERENCE TO A RELATED APPLICATION

This application is a continuation-in-part of a patent application Ser. No. 08/922,829 filed on Sep. 3, 1997 now abandoned.

BACKGROUND OF THE INVENTION

The present invention relates to a method of and device for magnetic-abrasive machining of parts.

The magnetic-abrasive machining of parts does not require that the accuracy of a machine tool be less than the specific accuracy of a workpiece. The realization of any precise geometrical form of workpiece is caused by a unique material removal mechanism which is disclosed for example in "Mechanism of Material Removal in the Magnetic Abrasive Process and the Accuracy of the Machining", G. Z. Kremen, et al., Int. J. Prod. Res., 1996, Volume 34, No. 9, Pages 2629–2638. This unique material removal mechanism, in addition to the accuracy of machining, to allow also machining hard and brittle materials, (ceramic, silicone) without their destruction. The other unique property of the process is that the peaks of the grains enter into the valleys of matching uneveness of the workpiece (see FIG. 2*a* of the same publication), and the material removal rate is higher close to the top of the peak than that at the bottom of the valley. As a result the surface of the parts machined with this method exhibits large ratios of length to amplitude. In other words, unevenesses of the surface do not have sharp edges. It is known that such a characteristic of the surface provide for a greater strength of the part, which is especially important for hard and brittle materials, such as ceramics, silicon, glass, etc.

Some methods and devices for magnetic-abrasive machining of parts are disclosed in U.S. Pat. Nos. 5,569,061 and 5,775,976. In this methods and devices, however, the material removal rate is low when compared with regular grinding. Also, non-magnetic parts can be machined when they have a small thickness, no more than 10–15 mm, while magnetic parts can be machined when they have a thickness of 100–120 mm. These disadvantages are connected with magnetic-properties of the parts to be machined and the magnetic-abrasive powders. Magnetic parts and powders contain steel which can not be magnetized more than its saturation limit about 2 T. The force of attracting a powder grain in the working gap is in cubic relation to the magnetic field strength, or in other words the magnetization of steel determines the material removal rate.

The magnetic-abrasive machining, in addition to the above mentioned two disadvantages has two properties which determine the efficiency of the process. First of all the powder must be pressed to the part to be machined, since if it is not pressed to the part there is no cutting force and therefore a cutting process. Secondly, the magnetic field must retain the powder in a working gap when the part is being machined and when it is not being machined.

In conventional magnetic-abrasive machining there is a contradiction in that, in order to increase the material removal rate it is necessary to increase a force which presses the powder to the part or in other words a cutting force. However, the increase of the cutting force leads to an increase in a friction force of the powder against the part. The magnetic force which retains the powder in the gaps has however a certain limit. The increase of the pressing force or cutting forces can lead to the situation that the friction force of the powder against the parts force the powder out of the working gap. In order to increase the material removal rate, it is proposed in U.S. Pat. Nos. 5,569,061 and 5,775,976 to change the nature of the force which presses the powder against the part. Hydrodynamic and aerodynamic forces are used in the solutions disclosed in these references. However, in order to use these forces it is necessary to provide additional devices which generate a jet and vacuum and supply the same into the cutting zone. In addition, the devices must be located in the machining zone, which makes difficult the operator's work. Also, the use of these devices requires high skills.

The magnetic-abrasive machining disclosed in this references includes the utilization of poles located opposite to one another. This approach has a certain limitation with regard to the diameter of the parts to be machined both magnetic and non magnetic. The magnitude of a gradient and the magnitude of the magnetic field in the working gap are related to one another. It has been determined experimentally that in order to retain the magnetic-abrasive powder in a working gap it is necessary to provide the magnitude of the magnetic field not less than B=0.8 T. When the magnetic is less than 0.8 T and the speed of rotation of the part is more or equal to 1 ms, the magnetic-abrasive powder is not retained and is forced out. The reason is that with the increase of the distance between the poles even for machining of a magnetic part, the field in the working gaps is reduced, and with the diameter of part more than 100–120 mm drops to B=0.8 T and less. This takes place under the condition that the external magnetic field is equal to 0.8–1.2 T or the powder and the parts are both magnetized into a saturation induction. In other words, the parts with the diameter more than 100–120 mm can not be machined with this method.

In the method disclosed in U.S. Pat. No. 5,813,901, FIG. 1, during the machining of a non-magnetic part, the magnetic-abrasive powder is not attracted to the part, but instead is attracted to the pole tips. With the maximum magnitude of the ferromagnetic field about 2 T and distance (gap) between the pole tips about 10–15 mm, the field drops below B=0.8 T. With this magnitude of the field, the magnetic-abrasive powder is not retained in the gap, if a non-magnetic part is introduced and attempted to be machined. In other words, the utilization of the oppositely located pole tips is limited by the possibility of machining of magnetic parts only in a diameter of not more than 100–120 mm, and non-magnetic parts with a diameter of 10–15 mm. The material removal rate is limited by a value of magnetization of steel in the part to be machined and the magnetic-abrasive powder.

Another method of magnetic-abrasive machining of both surfaces of even non-magnetic workpiece is disclosed in Japanese patent no. 62-39172. It also utilizes the oppositely located pole tips. However, here the parts to be machined are rotated, and the pole tips are rotated. This method has the disadvantages which are the same as in the above analyzed patents. It is not possible to machine non-magnetic parts with the thickness of more than 10–15 mm, and magnetic parts with the thickness of more than 100–120 mm. The material removal rate is limited by a magnitude of magnetization of the steel part and of the steel in the magnetic-abrasive powder.

U.S. Pat. No. 4,821,466 discloses a method in which the non-magnetic abrasive grains in a magnetic fluid are pushed to a workpiece with a floating pad being given a buoyant force. This patent has the same limitation with respect to the pressing of the powder to the part by a magnetic field. The material removal rate is limited by the magnitude of magnetization of steel powder in the magnetic fluid.

SUMMARY OF THE INVENTION

Accordingly, it is an object of the present invention to provide a method of and a device for magnetic-abrasive machining, which avoids the disadvantages of the prior art.

In keeping with these objects and with others which will become apparent hereinafter, one feature of the present invention resides, briefly stated in a method of and a device for magnetic-abrasive machining of a parts, which include generating a magnetic field by two different poles located near one another so as to form a magnetic gradient region with magnetic flux lines which are round in a predetermined plane, and extend from one pole in one direction and then in an opposite direction to another pole, placing a part to be machined exclusively at one side of the two poles, which project outwardly, introducing a magnetic-abrasive powder between the poles and the part to be machined so that a portion of the part to be machined is located in the magnetic gradient region with the round magnetic flux lines, and moving the part to be machined relative to the poles in the same plane of the round magnetic flux lines of the magnetic gradient region so that portions of the part to be machined successively pass the magnetic gradient region with the round magnetic flux lines with a speed of cutting hundres times greater than that of other movements; oscillation, feed, etc. and are machined by the magnetic-abrasive powder retained in the magnetic gradient region with the round magnetic flux lines.

It is another feature of present invention to provide a device for a magnetic-abrasive machining of parts which includes retaining the magnetic head freely so that the magnetic-abrasive powder is forced against the part to be machined under the action of a magnetic attraction of the magnetic-abrasive powder and the magnetic head to the part to be machined.

When the method is performed and the device is designed in accordance with the present invention, they avoid the disadvantages of the prior art and provide for the highly advantageous results. In accordance with the present invention, the grains of the magnetic-abrasive powder are retained by the magnetic-gradient region of the magnetic field which has round magnetic flux lines. There are no limitations as to the size of parts to be machined since they are located exclusively at one side of the poles. There are no limitations as to the speeds of movement of the parts to be machined since the magnetic-abrasive powder is reliably retained in the machining zone regardless of the magnitude of the speeds.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
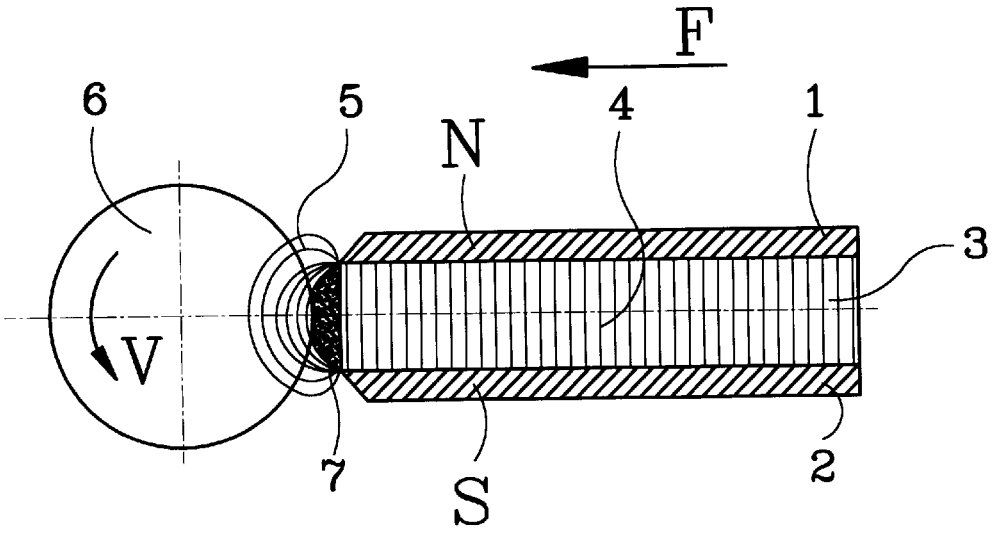
FIG. 1 is a view showing an inventive method and a device for a magnetic-abrasive machining of parts in accordance with one embodiment of the present invention.

An inventive magnetic-abrasive device for machining of parts in accordance with an inventive method has two different poles N and S formed for example by two pole tips 1 and 2 arranged on a permanent magnet 3. The tips I and 2 project outwardly beyond the permanent magnet 3 at the left side of the permanent magnet as shown in FIG. 1. A magnetic field is generated which includes a magnetic field region 4 having straight magnetic flux lines extending between the poles. Also, the magnetic field includes another, magnetic gradient region identified with reference numeral 5. The magnetic flux lines of the magnetic gradient region 5 extend from one pole in one direction and then back to another pole and are substantially round as shown in FIG. 1. The magnetic-flux lines are therefore very dense and the magnetic gradient region 5 has a high magnetic field intensity.

Figure 2:
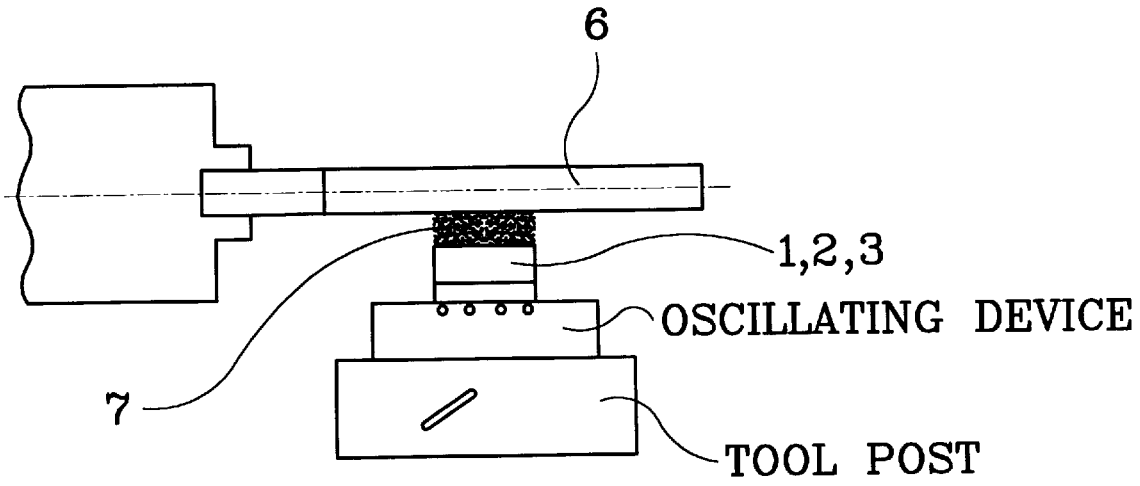
FIG. 2 is a view showing a method of and a device for magnetic-abrasive machining of parts on a power tool.

A cylindrical part 6 to be machined or at least a portion of a surface of the part 6 to be machined is located exclusively at one side of both poles which project outwardly. The portion of the surface of the part 6 to be machined is located in a magnetic gradient region 5 with the round magnetic flux lines. A magnetic-abrasive powder 7 is introduced between a magnetic head formed by the elements 1, 2, 3 and the part 6 to be machined, and the magnetic head 1, 2, 3 is moved toward the part 6 to be machined so as to force the magnetic-abrasive powder 7 to the part 6 to be machined. Then the part 6 to be machined is rotated by conventional means around an axis of rotation, FIG. 2. As can be seen from the drawings, the round magnetic flux lines of the magnetic gradient region 5 are located in the drawing plane, and the axle of the part 6 to be machined is rotated perpendicularly to the plane of drawings.

During rotation of the part 6 to be machined, the magnetic-abrasive machining of successive portions of the surface of the part 6 to be machined is performed by the magnetic-abrasive powder 7. The magnetic-abrasive powder 7 is firmly retained in the magnetic gradient region with the round magnetic flux lines during the machining, and not withdrawn from the machining zone formed between the magnetic head 1, 2, 3 and the part 6 to be machined. The part 6 to be machined is rotated perpendicularly to the round magnetic flux lines of the magnetic gradient region 5.

Figure 3:
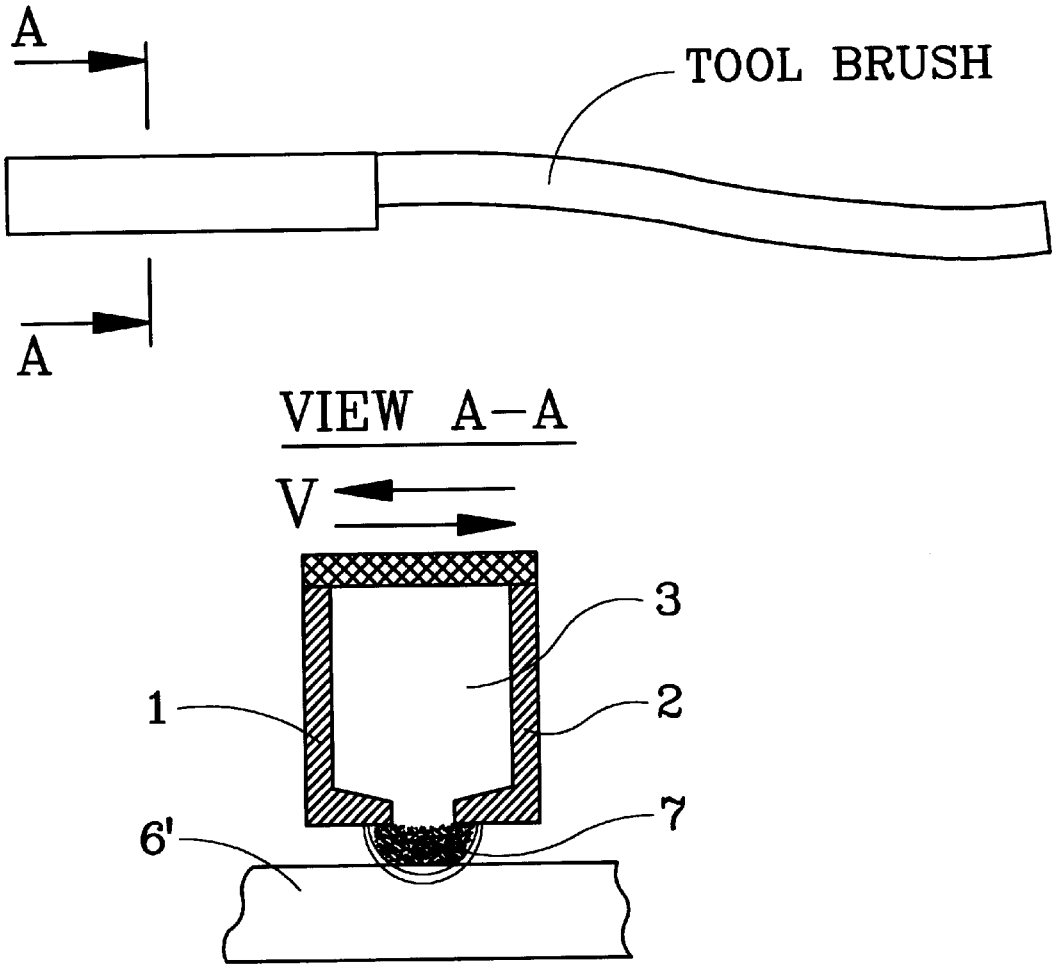
FIG. 3 is a view showing a method of and a device for magnetic-abrasive machining of parts in accordance with still a further embodiment of the present invention.

It is to be understood that the part 6*a* to be machined not necessarily has to be rotated, it can be also displaced translatorily relative to the magnetic head 1, 2, 3, for example reciprocates as shown in FIG. 3. It could be an industrial brush or a tooth brush.

Figure 4:
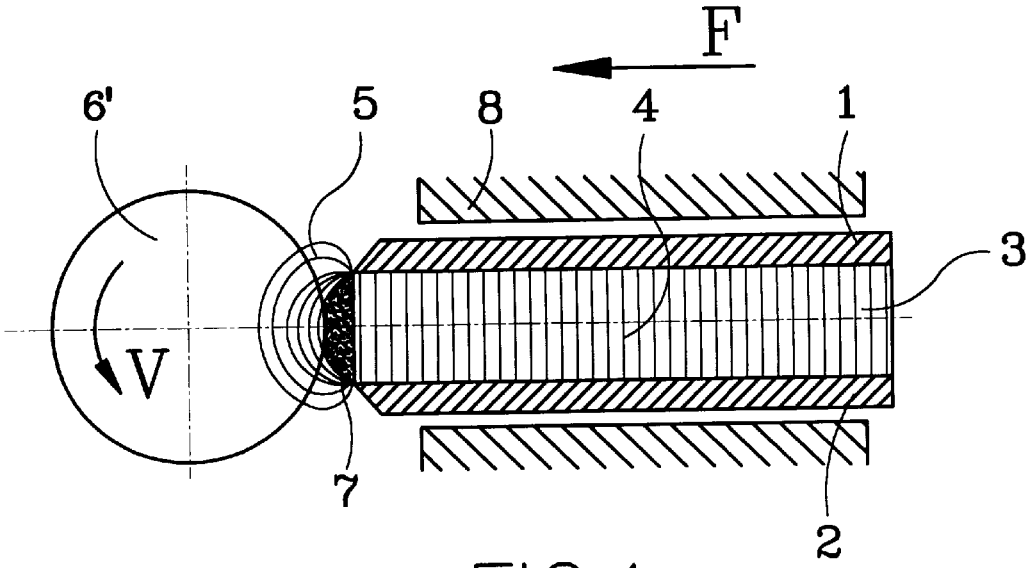
FIG. 4 is a view showing the inventive magnetic-abrasive machining of a magnetic part.

FIG. 4 shows another embodiment of the present invention. In this embodiment the part 6' to be machined is a magnetic part. The magnetic head 1, 2, 3 is arranged in guides 8 so that it can freely move in the guides. While in the embodiment of FIG. 1 in which the part 6 to be machined was non-magnetic is was necessary to move the magnetic head 1, 2, 3 toward the part 6 to be machined to force the magnetic-abrasive powder 7 to the part 6 to be machined, in the embodiment of FIG. 3, the magnetic-abrasive powder 7 and the magnetic-head 1, 2, 3 are attracted to the magnetic part 6' to be machined in the feed direction. Thereby the magnetic-abrasive powder 7 is pressed against the magnetic part 6' to be machined.

Figure 5:
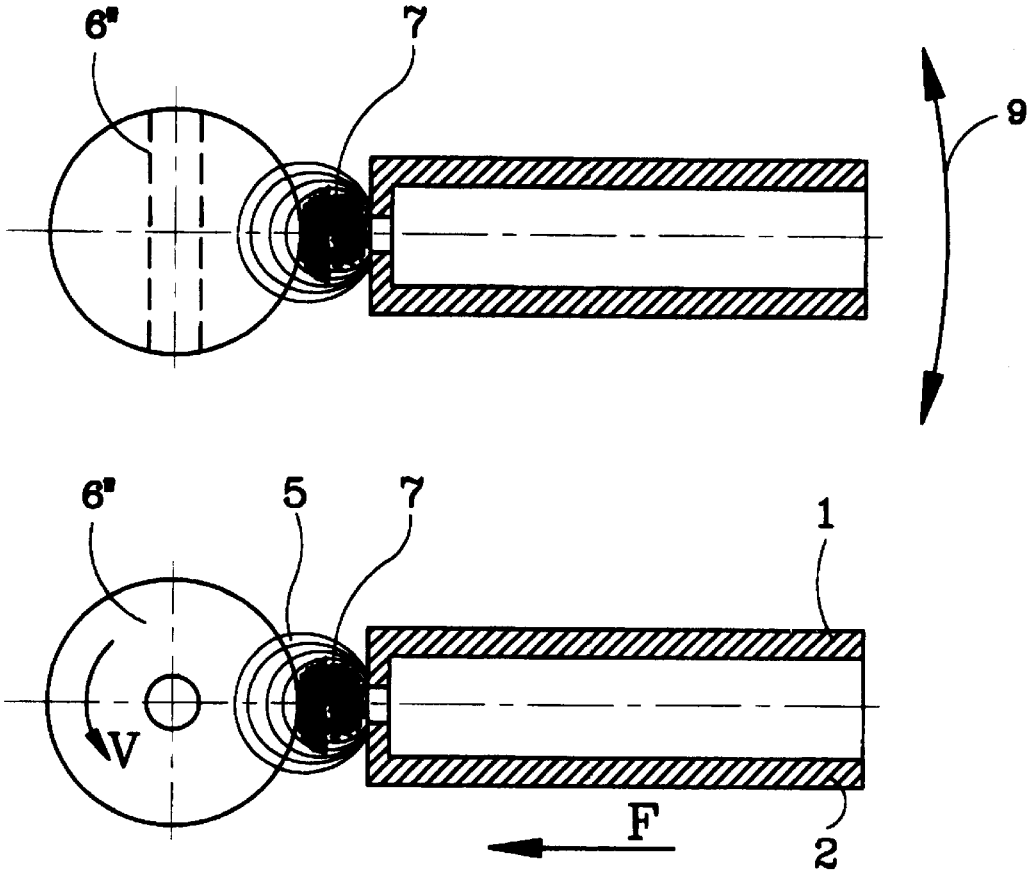
FIG. 5 is a view showing the inventive magnetic-abrasive machining of a spherical part.

FIG. 5 shows the magnetic-abrasive machining of a spherical part 6". In this embodiment the part 6" to be machined is also rotated in a plane coinciding with the plane in which the round magnetic flux lines of the magnetic gradient region 5 are located. However, here in addition, the magnetic head 1, 2, 3, is oscillated along an arc 9. Therefore, a spherical surface of the part 6" is machined by the magnetic-abrasive powder 7.

Figure 6:
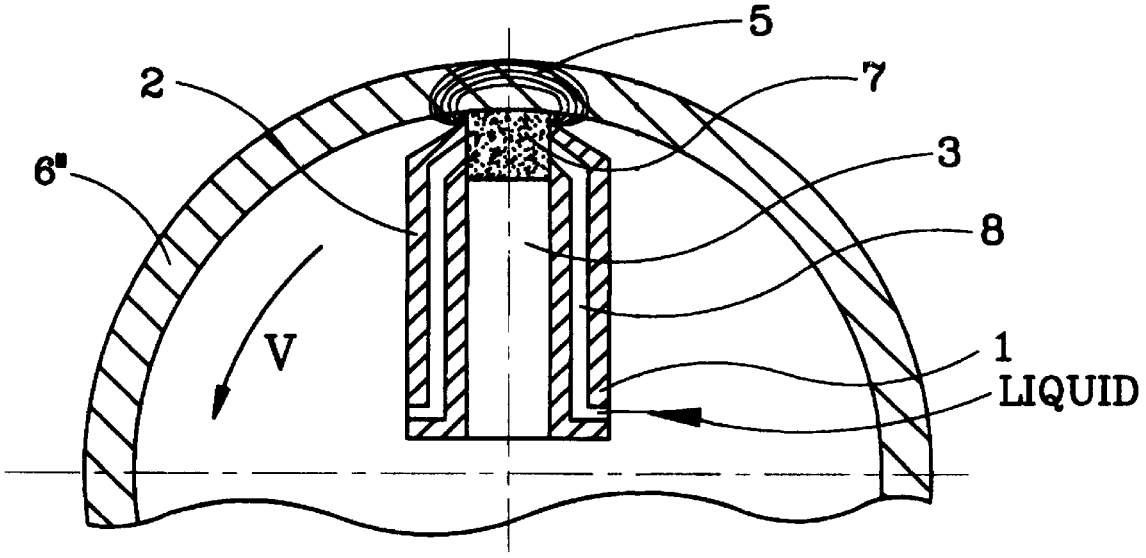
FIG. 6 is a view showing the inventive magnetic-abrasive machining of a hollow part.

FIG. 6 illustrates magnetic-abrasive machining of an inner cylindrical surface of the part 6" in accordance with the inventive method. The magnetic head 1, 2, 3, forms a round magnetic gradient 5 and simultaneously presses the magnetic-abrasive powder 7 toward the part 6", while a liquid (for example a cooling liquid) is supplied through holes 8. The part 6" rotates, and also the part 6" or the magnetic head 1, 2, 3 oscillates.

It is to be understood that the magnet in the present invention can be a permanent magnet, an electromagnet, a superconductive magnet, etc.

It will be understood that each of the elements described above, or two or more together, may also find a useful application in other types of methods and constructions differing from the types described above.

While the invention has been illustrated and described as embodied in method and device for magnetic-abrasive machining of parts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of magnetic-abrasive machining of a parts, comprising the steps of generating a magnetic field by two different poles located near one another so as to form a magnetic gradient region with magnetic flux lines which extend from one pole in one direction and then in an opposite direction to another pole and therefore are round in a predetermined plane; placing a part to be machined exclusively at one side of the two poles; introducing a magnetic-abrasive powder between the poles and the part to be machined so that a portion of the part to be machined is located in the magnetic gradient region with the round magnetic flux lines; and moving the part to be machined relative to the poles in the same plane transversely to the round magnetic flux lines of the magnetic gradient region so that portions of the part to be machined successively pass the magnetic gradient region with the round magnetic flux lines and are machined by the magnetic-abrasive powder retained in the magnetic gradient region with the round magnetic flux lines.

2. A method as defined in claim 1, further comprising the step of forcing the magnetic-abrasive powder against the part to be machined, by displacing the poles toward the part to be machined.

3. A method as defined in claim 1, wherein the part to be machined is a magnetic part; and further comprising the step of retaining the poles freely in guides, and forcing the magnetic-abrasive powder is forced against the part to be machined under the action of a magnetic attraction of the magnetic-abrasive powder and the poles to the part to be machined.

4. A device for a magnetic-abrasive machining of a part, comprising means for generating a magnetic field and including two different poles located near one another so as to form a magnetic gradient region with magnetic flux lines which extend from one of said poles to another of said poles and are round in a predetermined plane; means for placing a part to be machined exclusively at one side of said two poles; a magnetic-abrasive powder introduced between said poles and the part to be machined so that at least a portion of the part to be machined is located in the magnetic gradient region with the round magnetic flux lines; and means for moving the part to be machined relative to said poles in the same plane transversely to the round magnetic flux lines of the magnetic gradient region so that portions of the part to be machined successively pass the magnetic gradient region with the round magnetic flux lines and are machined by the magnetic-abrasive powder retained in the magnetic gradient region with the round flux lines.

5. A device as defined in claim 4, further comprising means for moving the poles toward the part to be machined so as to force the magnetic-abrasive powder toward the one of said elements.

6. A device as defined in claim 4, wherein the part to be machined is a magnetic part; and further comprising means for freely guiding the part to be machined so that the magnetic-abrasive powder is forced against the part to be machined by the magnetic attraction of the magnetic-abrasive powder and the freely guided poles toward the part to be machined.

* * * * *